US008398422B2

(12) United States Patent
Zhu

(10) Patent No.: US 8,398,422 B2
(45) Date of Patent: Mar. 19, 2013

(54) CARD EDGE CONNECTOR

(75) Inventor: Jian-Kuang Zhu, Kunshan (CN)

(73) Assignee: Hon Hai Precision Ind. Co., Ltd, New Taipei (TW)

( * ) Notice: Subject to any disclaimer, the term of this patent is extended or adjusted under 35 U.S.C. 154(b) by 0 days.

(21) Appl. No.: 13/155,407

(22) Filed: Jun. 8, 2011

(65) Prior Publication Data

US 2011/0300734 A1 Dec. 8, 2011

(30) Foreign Application Priority Data

Jun. 8, 2010 (CN) ..... 2010 2 0219142

(51) Int. Cl.
*H01R 13/62* (2006.01)

(52) U.S. Cl. ..... 439/326

(58) Field of Classification Search ..... 439/326, 439/325, 733.1, 345, 603, 495, 862, 869
See application file for complete search history.

(56) References Cited

U.S. PATENT DOCUMENTS 3,848,952 A * 11/1974 Tighe, Jr. ..... 439/326
4,780,095 A * 10/1988 Classon et al. ..... 439/637
5,286,218 A * 2/1994 Sakurai et al. ..... 439/444
5,309,630 A * 5/1994 Brunker et al. ..... 29/842
5,370,559 A * 12/1994 Matsuoka ..... 439/733.1
5,676,555 A * 10/1997 Yu et al. ..... 439/157
5,735,696 A * 4/1998 Niitsu et al. ..... 439/65
5,913,700 A * 6/1999 Tobey et al. ..... 439/637
5,915,979 A * 6/1999 Schell et al. ..... 439/83
5,984,708 A * 11/1999 Yu ..... 439/326
5,984,735 A * 11/1999 Daoud ..... 439/733.1
6,149,453 A * 11/2000 Hollesen et al. ..... 439/395
6,183,283 B1 * 2/2001 Kurotori et al. ..... 439/326
6,210,194 B1 * 4/2001 Choy ..... 439/326
6,358,061 B1 * 3/2002 Regnier ..... 439/60
6,394,823 B1 * 5/2002 Dunham et al. ..... 439/108
6,431,889 B1 * 8/2002 Olson ..... 439/157
6,821,144 B2 * 11/2004 Choy ..... 439/541.5
7,025,617 B2 * 4/2006 Regnier et al. ..... 439/329
7,059,883 B2 * 6/2006 Tsai ..... 439/326
7,083,456 B2 * 8/2006 Trout et al. ..... 439/326
7,175,480 B2 * 2/2007 Yamashita ..... 439/733.1
7,195,498 B1 * 3/2007 Wang et al. ..... 439/83
7,198,519 B2 * 4/2007 Regnier et al. ..... 439/637
7,357,663 B2 * 4/2008 Wei et al. ..... 439/495
7,361,023 B2 * 4/2008 Wu ..... 439/66
7,364,467 B2 * 4/2008 Chen et al. ..... 439/633
7,438,601 B2 * 10/2008 Kobayashi ..... 439/636
7,442,089 B2 * 10/2008 Regnier ..... 439/637
7,491,092 B2 * 2/2009 Zhu et al. ..... 439/633
7,497,714 B2 * 3/2009 Wang ..... 439/328

(Continued)

*Primary Examiner* — Amy Cohen Johnson
*Assistant Examiner* — Vladimir Imas
(74) *Attorney, Agent, or Firm* — Wei Te Chung; Ming Chieh Chang

(57) ABSTRACT

A card edge connector includes an elongated housing having an upper face, a lower face and a mating groove defined therebetween and extending along a longitudinal direction. A plurality of terminal grooves are respectively defined between the upper face and lower face and in communication with the mating groove. A plurality of contacts are respectively received in the terminal grooves. Each contact includes a body portion, at least one retaining portion, a contacting portion and a soldering portion. The at least one retaining portion forms at least one barb thereon and is inserted into the terminal groove with the at least one barb interfering with an inner wall of the terminal groove until the at least one barb falls into a through hole defined on the inner wall of the terminal groove.

14 Claims, 5 Drawing Sheets

U.S. PATENT DOCUMENTS

| | | | | |
|---|---|---|---|---|
| 7,556,527 | B2 * | 7/2009 | Li et al. | 439/541.5 |
| 7,614,899 | B2 * | 11/2009 | Zhu et al. | 439/325 |
| 7,658,658 | B2 * | 2/2010 | Zhu | 439/862 |
| 7,794,259 | B2 * | 9/2010 | Zhu et al. | 439/327 |
| 7,806,698 | B2 * | 10/2010 | Regnier | 439/37 |
| 7,862,370 | B1 * | 1/2011 | Chen | 439/495 |
| 7,878,846 | B2 * | 2/2011 | Zhu | 439/541.5 |
| 7,927,114 | B2 * | 4/2011 | Li et al. | 439/108 |
| 7,938,687 | B2 * | 5/2011 | Zhu | 439/631 |
| 7,985,089 | B2 * | 7/2011 | Zhu et al. | 439/326 |
| 8,109,777 | B2 * | 2/2012 | Zhu | 439/326 |
| 8,123,542 | B2 * | 2/2012 | Kimura et al. | 439/326 |
| 8,123,574 | B2 * | 2/2012 | Ma | 439/862 |
| 2003/0224632 | A1 * | 12/2003 | Regnier et al. | 439/79 |
| 2007/0010125 | A1 * | 1/2007 | Regnier | 439/495 |
| 2007/0173126 | A1 * | 7/2007 | Chen et al. | 439/633 |
| 2008/0207058 | A1 * | 8/2008 | Zhu et al. | 439/633 |
| 2009/0142944 | A1 * | 6/2009 | Zhu | 439/79 |
| 2009/0156047 | A1 * | 6/2009 | Zhu et al. | 439/352 |
| 2009/0163055 | A1 * | 6/2009 | Zhu | 439/83 |
| 2009/0191763 | A1 * | 7/2009 | Zhu et al. | 439/632 |
| 2009/0291581 | A1 * | 11/2009 | Zhu et al. | 439/325 |
| 2010/0227508 | A1 * | 9/2010 | Zhu | 439/631 |
| 2010/0248517 | A1 * | 9/2010 | Li et al. | 439/327 |
| 2011/0039454 | A1 * | 2/2011 | Zhu et al. | 439/680 |
| 2011/0300734 | A1 * | 12/2011 | Zhu | 439/325 |

* cited by examiner

CARD EDGE CONNECTOR

BACKGROUND OF THE INVENTION

1. Field of the Invention

The present invention relates to a card edge connector, and in particular to a card edge connector connecting an electronic card to a printed circuit board.

2. Description of the Related Art

U.S. Pat. No. 7,195,498 issued to Wang et al. on Mar. 27, 2007 discloses a card edge connector connecting an electronic card to a printed circuit board. The card edge connector comprises an insulative housing with a pair of side arms extending forwardly from two opposite ends. The insulative housing forms an upper wall, a lower wall and a central slot defined therebetween for receiving the electronic card. A plurality of upper and lower terminal grooves are respectively defined on the upper and lower walls for receiving conductive terminals therein. Each conductive terminal comprises an elongated body portion, a contacting portion extending forwardly from one end of the body portion in a slantwise manner, at least one retention portion extending forwardly from a middle portion of the body portion, and a solder portion extending rearwardly from the other end of the body portion. Each retention portion forms a plurality of barbs thereon for interfering with inner walls of the terminal groove so as to secure the conductive terminal in the terminal groove. However, the interfering force between the conductive terminal and the inner walls may result distortion of the conductive terminal or rotation of the conductive terminal. Obviously, an improved card edge connector is highly desired to overcome the aforementioned problem.

SUMMARY OF THE INVENTION

Accordingly, an object of the present invention is to provide a card edge connector with conductive terminals secured in the insulative housing steadily and orderly.

In order to achieve the object set forth, a card edge connector includes an elongated housing having an upper face, a lower face and a mating groove defined therebetween and extending along a longitudinal direction. A plurality of terminal grooves are respectively defined between the upper face and lower face and in communication with the mating groove. A plurality of contacts are respectively received in said terminal grooves. Each contact includes a body portion, at least one retaining portion extending from a side edge of the body portion, a contacting portion extending from an end of the body portion and a soldering portion extending from the other end of the body portion. The at least one retaining portion forms at least one barb thereon and is inserted into the terminal groove with the at least one barb interfering with an inner wall of the terminal groove until the at least one barb falls into a through hole defined on said inner wall of the terminal groove.

Other objects, advantages and novel features of the invention will become more apparent from the following detailed description of the present embodiment when taken in conjunction with the accompanying drawings.

DETAILED DESCRIPTION OF THE INVENTION

Figure 1:
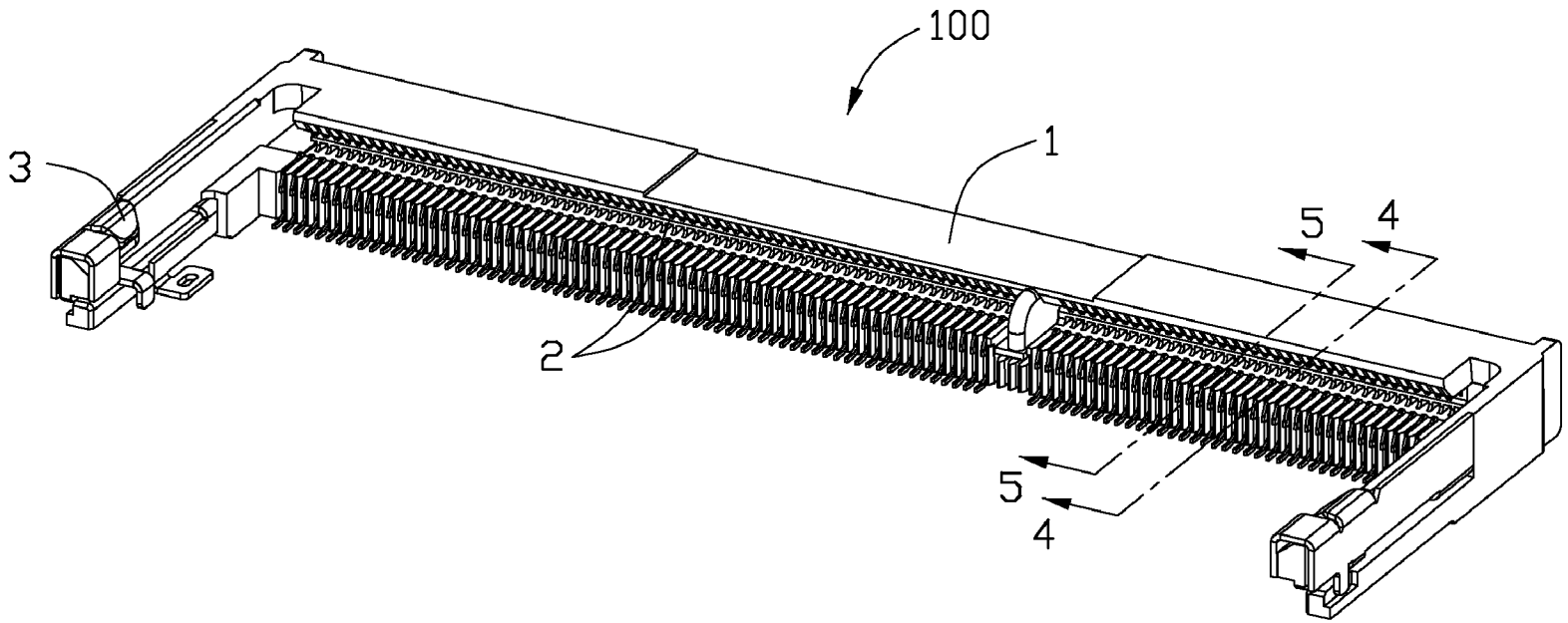
FIG. 1 is a perspective view of a card edge connector in accordance with the present invention.
Figure 2:
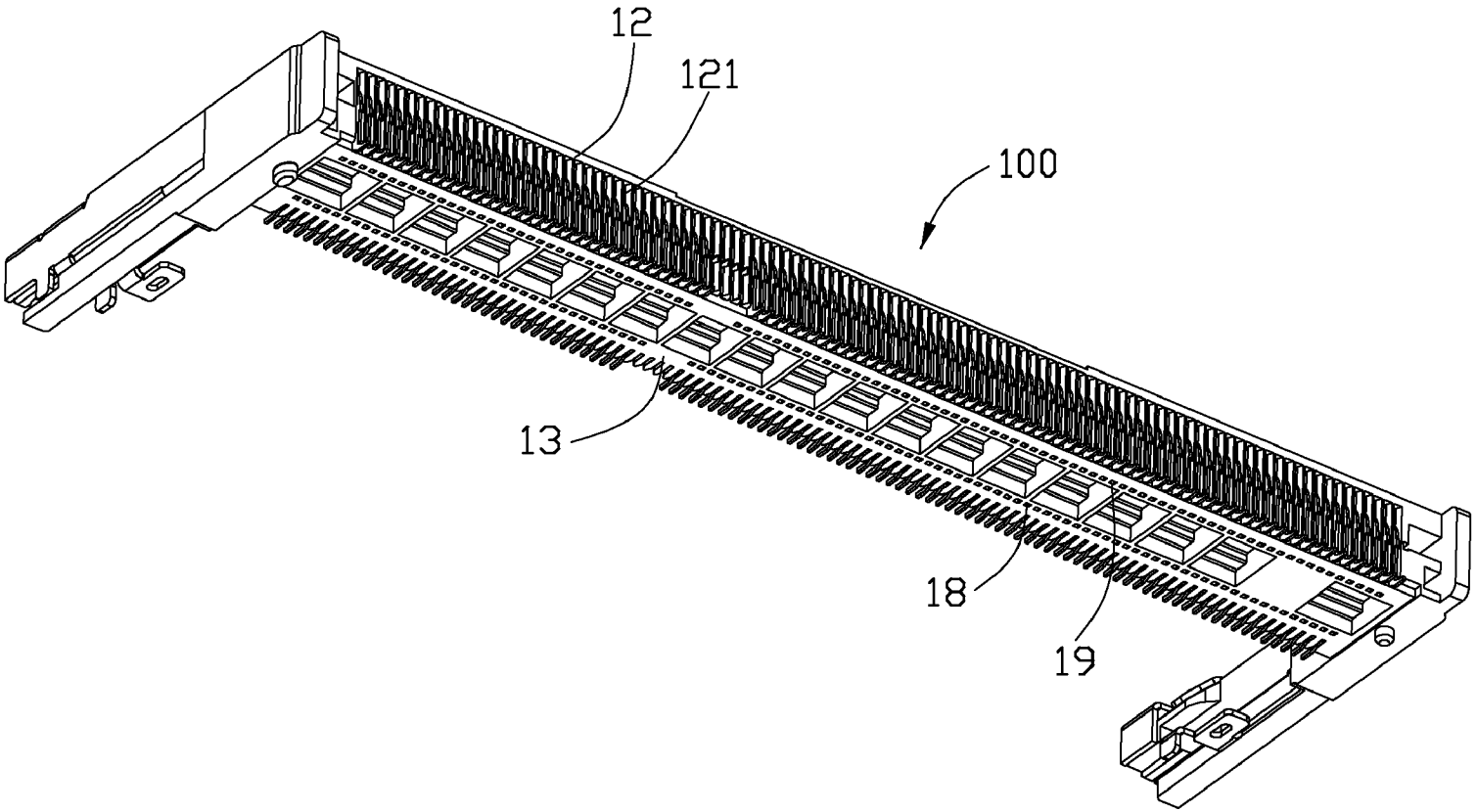
FIG. 2 is another perspective view of the card edge connector shown in FIG. 1.

Reference will now be made to the drawing figures to describe a preferred embodiment of the present invention in detail. Referring to FIG. 1 to FIG. 2, a card edge connector 100 according to the preferred embodiment of the present invention is provided for connecting an electronic card to a printed circuit board (PCB). The card edge connector 100 comprises an insulative housing 1 with a plurality of conductive terminals 2 received therein and a pair of metallic devices 3 at opposite ends of the insulative housing 1.

The insulative housing 1 comprises an elongated base portion 10 and a pair of arms 15 disposed at opposite longitudinal ends of the base portion 10 and extending along a rear-to-front direction thereby defining a receiving space therebetween for receiving the electronic card. The base portion 10 forms a front face 11, a rear face 12 opposite to the front face 11, and a bottom face 13 connecting with the front face 11 and the rear face 12. A mating groove 14 is defined along a longitudinal direction of the base portion 10 and extends rearward from the front face 11 to the rear face 12. First terminal grooves 111 and second terminal grooves 121 are respectively defined on the opposite sides of the mating groove 14 and stagger with each other along the longitudinal direction. Each first terminal groove 111 extends from the front face 11 of the base portion 10, and each second terminal groove 121 extends from the rear face 12 of the base portion 10. A key 17 for cooperating with a notch defined at the front edge of the electronic card is formed in the mating groove 14 adjacent to one of the arms 15 so as to realize an anti-mismating function. Further, the metallic devices 3 are respectively assembled on the arms 15 for strengthening the rigidity of the arms 15.

Figure 4:
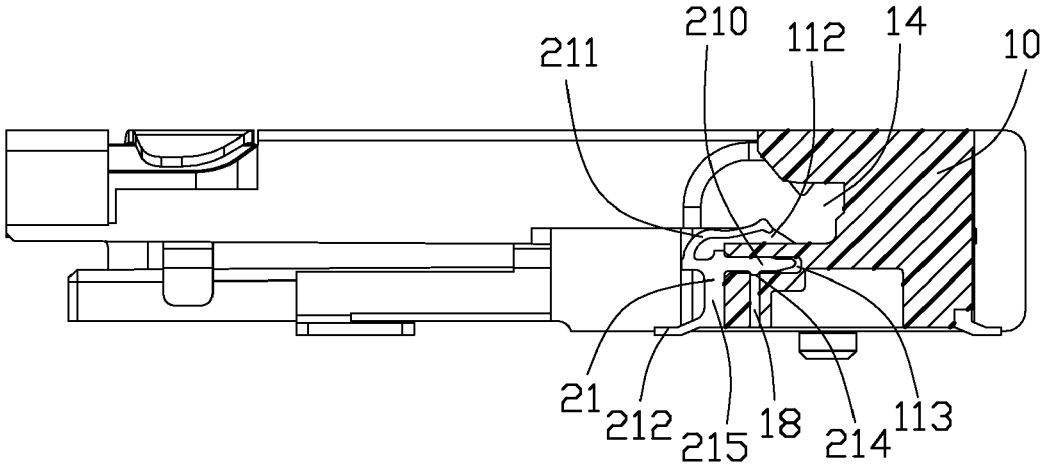
FIG. 4 is a cross-sectional view of the card edge connector shown in FIG. 1 along line 4-4.
Figure 5:
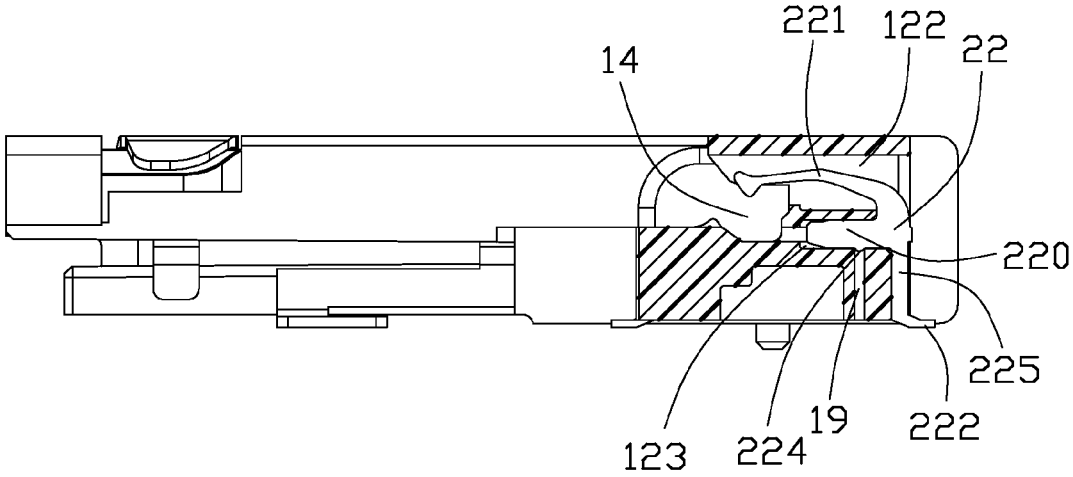
FIG. 5 is a cross-sectional view of the card edge connector shown in FIG. 1 along line 5-5.

Referring to FIGS. 2, 4, 5, the first terminal groove 111 comprises a first horizontal slot 112 and a first retaining slot 113 in a parallel relationship. The first horizontal slot 112 extends upwardly and communicates with the mating groove 14. The second terminal groove 121 comprises a second horizontal slot 122 and a second retaining slot 123 in a parallel relationship. The second horizontal slot 122 extends downwardly and communicates with the mating groove 14. The first retaining slot 113 is adjacent to the front face 11 while the second retaining slot 123 is adjacent to the rear face 12. The insulative housing 1 defines a row of first through holes 18 and a row of second through holes 19 running upwardly from the bottom face 13 along a vertical direction perpendicular to the longitudinal direction. The first through holes 18 are closer to the front face 11 while the second through holes 19 are closer to the rear face 12. Further, the first and second through holes 18, 19 are respectively communicate with the first retaining slots 113 and second retaining slots 123.

Figure 3:
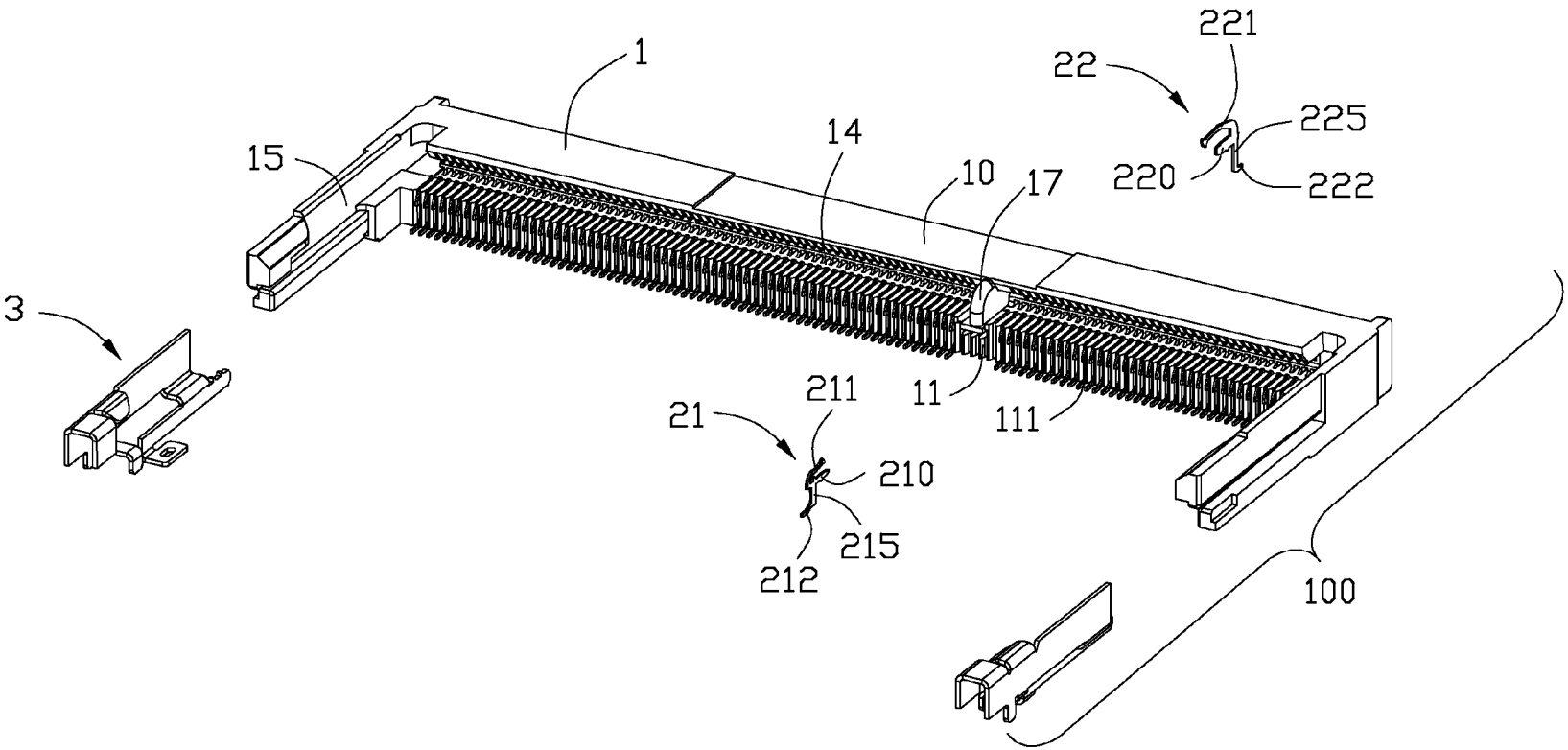
FIG. 3 is an exploded perspective view of the card edge connector shown in FIG. 1.

Referring to FIGS. 3-5, the conductive terminals 2 comprises first terminals 21 received in the first terminal grooves 111 and second terminals 22 received in the second terminal grooves 121. The structures of each first terminal and second terminal 21, 22 are nearly the same, respectively comprise a first and a second body portions 215, 225 extending along the vertical direction, a first and a second retaining portions 210, 220 extending from a side edge of the first and second body portions 215, 225, a first and a second contacting portions 211, 221 extending from an upper end of the first and second body portions 215, 225, and a first and a second soldering portions 212, 222 extending from a lower end of the first and second body portions 215, 225. The first and second retaining portions 210, 220 respectively form a plurality of barbs 214, 224 thereon. The first terminals 21 insert into the first terminal grooves 111 from the front face 11, with the first retaining portions 210 received in the first retaining slot 113 and the first contacting portion 211 received in the first horizontal slot 112 and partly projecting into the mating groove 14. The second terminals 22 insert into the second terminal grooves 121 from the rear face 12, with the second retaining portion 220 received in the second retaining slot 123 and the second contacting portion 221 received in the second horizontal slot 122 and partly projecting into the mating groove 14.

When the first and second retaining portions 210, 220 are inserted into the first and second retaining slots 113, 123, barbs 214, 224 on the first and second retaining portions 210, 220 will fall into the first and second through holes 18, 19 respectively. In this state, the interfering force between the barbs 214, 224 and inner walls of the first and second retaining slots 113, 123 will reduce to the minimum value, therefore distortion of the conductive terminals 2 can be improved and the soldering portions of the conductive terminals 2 can reach to a better coplanarity. Further, as the barbs 214, 224 buckle with the first and second through holes, the conductive terminals 2 will not rotate about the barbs accidently and can be secured in the insulative housing steadily.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A card edge connector for connecting an electronic card to a printed circuit board comprising:

an elongated housing having an upper face, a lower face and a mating groove defined therebetween and extending along a longitudinal direction, a plurality of terminal grooves respectively defined between the upper face and lower face and in communication with the mating groove; and a plurality of contacts, respectively received in said terminal grooves, each comprising a body portion, at least one retaining portion extending from a side edge of the body portion, a contacting portion extending from an end of the body portion and a soldering portion extending from the other end of the body portion; wherein the at least one retaining portion forms at least one barb thereon and is inserted into the terminal groove with the at least one barb interfering with an inner wall of the terminal groove until the at least one barb falls into a through hole defined on said inner wall of the terminal groove;

wherein the at least one barb is stiff and is restricted in the through hole under condition that the at least one barb contacts with opposite inner surfaces of the through hole and is sandwiched between the opposite inner surfaces;

wherein said through hole extends from the upper face or the lower face of the housing and is perpendicular to said terminal groove;

wherein each terminal groove comprises a retaining slot and a horizontal slot, said retaining portion of the contact is fixed in the retaining slot and said contacting portion of the contact is received in the horizontal slot and partly exposed in the mating groove;

wherein each through hole communicates with the retaining slot while separates from the horizontal slot.

2. The card edge connector as described in claim 1, wherein a pair of side arms are disposed at opposite ends of the housing, and a key is formed within the mating groove adjacent to one of the side arms.

3. A card connector comprising:

an insulative housing having an upper wall, a lower wall and a mating groove defined therebetween, a plurality of first and second terminal grooves respectively defined on said upper and lower walls;

a pair of side arms, disposed at opposite ends of the insulative housing;

a plurality of contacts, divided into a first row of contacts and a second row of contacts and respectively received in said first and second terminal grooves; wherein at least one row of the contacts form barbs thereon for buckling with through holes defined in the corresponding terminal grooves;

wherein each barb is stiff and is immovably received in a corresponding through hole by contacting with opposite inner surfaces of the through hole.

4. The card connector as described in claim 3, wherein the through holes extend along a first direction perpendicular to a second direction along which the terminal grooves extend.

5. The card connector as described in claim 3, wherein the first and second rows of contacts are respectively inserted into the first and second terminal grooves along reverse directions.

6. The card connector as described in claim 4, wherein a key is formed within the mating groove and located adjacent to one of the side arms.

7. An electrical connector comprising:

an insulative housing defining respectively a plurality of passageways extending along a front-to-back direction;

a plurality of contacts disposed in the corresponding passageways, respectively;

each of said contacts defining a retention arm from which a contacting portion and a tail portion extend respectively, a symmetrical stiff barb structure directly formed on an edge of said retention arm; and a recessed structure formed in the housing beside each corresponding passageway and extending in a direction perpendicular to the front-to-back direction to receive the corresponding symmetrical stiff barb structure therein;

wherein the symmetrical stiff barb structure is symmetrically restrained in the recessed structure in the front-to-back direction.

8. The electrical connector as claimed in claim 7, wherein said retention arm extends horizontally and defines opposite upper and bottom edges thereof including said one edge on which the barb is formed.

9. The electrical connector as claimed in claim 8, wherein said barb is formed on the bottom edge.

10. The electrical connector as claimed in claim 9, wherein said recessed structure is essentially a through hole extending through a bottom face of the housing.

11. The electrical connector as claimed in claim 10, wherein the contacting portion extends from the upper edge of the retention arm of the corresponding contact.

12. The electrical connector as claimed in claim 11, wherein said housing defines a receiving slot in communication with the passageways.

13. The electrical connector as claimed in claim 12, wherein the contacting portion extends into the receiving slot.

14. The electrical connector as claimed in claim 7, wherein said recessed structure forms a pair of opposite symmetrical inner surface to symmetrically restrain the corresponding barb in said front-to-back direction.

* * * * *